US007510445B2

(12) United States Patent
Tokunaga

(10) Patent No.: US 7,510,445 B2
(45) Date of Patent: Mar. 31, 2009

(54) CONNECTOR WITH HIGH CONNECTION RELIABILITY

(75) Inventor: Takashi Tokunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/900,371

(22) Filed: Sep. 11, 2007

(65) Prior Publication Data

US 2008/0064229 A1 Mar. 13, 2008

(30) Foreign Application Priority Data

Sep. 12, 2006 (JP) ..... 2006-246768

(51) Int. Cl.
*H01R 24/00* (2006.01)

(52) U.S. Cl. ..... 439/634; 439/74; 439/600

(58) Field of Classification Search ..... 439/634, 439/631, 74, 660
See application file for complete search history.

(56) References Cited

U.S. PATENT DOCUMENTS 4,734,060 A * 3/1988 Kawawada et al. ..... 439/660
5,181,855 A * 1/1993 Mosquera et al. ..... 439/74
5,575,690 A * 11/1996 Eaton ..... 439/717
5,593,311 A 1/1997 Lybrand

FOREIGN PATENT DOCUMENTS

| | | |
|---|---|---|
| JP | 51-089184 | 8/1976 |
| JP | 52-012141 | 1/1977 |
| JP | H05-7829 | 2/1990 |
| JP | 2871128 | 9/1992 |
| JP | 2005005158 | 1/2005 |
| JP | 7-147171 | 6/2005 |

OTHER PUBLICATIONS

Japanese Office Action dated Jun. 25, 2008.

* cited by examiner

*Primary Examiner*—Truc T Nguyen
(74) *Attorney, Agent, or Firm*—Collard & Roe, P.C.

(57) ABSTRACT

In a connector adapted for connection to a mating connector, each contact includes a holding portion held by the housing, a contact receiving portion extending from the holding portion and adapted to contact a contact portion of a corresponding one of contacts of a mating connector, a spring portion extending from the contact receiving portion and movable relative to the housing, and a contact portion provided at the spring portion and adapted to contact a contact receiving portion of the corresponding contact of the mating connector. The housing includes accommodating portions accommodating therein at least portions of the contact receiving portions of the contacts, respectively, and guide portions adapted to guide the contact portions of the contacts of the mating connector toward the accommodating portions, respectively.

12 Claims, 5 Drawing Sheets

CONNECTOR WITH HIGH CONNECTION RELIABILITY

This application claims the benefit of priority from Japanese patent application No. 2006-246768, filed on Sep. 12, 2006, the disclosure of which is incorporated herein in its entirety by reference.

BACKGROUND OF THE INVENTION

This invention relates to a connector including a housing and contacts coupled thereto and further relates to a connecting device using such a connector.

An example of this type of connector is disclosed in Japanese Patent Application Publication (JP-B) No. H05-7829. The connector will be described with reference to FIG. 1.

FIG. 1 is an exemplary diagram showing the behavior of contacts 42 and 52 in a fitting operation, from its beginning to end, between two connectors 41 and 51. Central axes 43 and 53 of the contacts 42 and 52 are aligned with each other.

In the beginning of the fitting operation of the connectors 41 and 51, circular-arc contact points 42*a* and 52*a* of the contacts 42 and 52 move in sliding contact with each other and ride over each other as shown at (a) to (c) in FIG. 1.

As shown at (d) in FIG. 1, as the fitting operation of the connectors 41 and 51 progresses, the contact point 42*a* and the contact point 52*a* move in sliding contact with each other along an inclined contact surface 52*b*1 of the contact 52 and an inclined contact surface 42*b*1 of the contact 42, respectively. Following the movement, elastically deformable portions 42*b* and 52*b* respectively having the contact points 42*a* and 52*a* are displaced against their respective elastic forces. In this event, because of the presence of the inclined contact surfaces 42*b*1 and 52*b*1, concentration of loads on fixed portions 42*c* and 52*c* of the contacts 42 and 52 to cause deformation thereof is prevented.

Finally, as shown at (e) in FIG. 1, the contact point 42*a* and the contact point 52*a* ride over and elastically contact a flat contact surface 52*b*2 and a flat contact surface 42*b*2, respectively.

This type of connector is also disclosed, for example, in Japanese Patent (JP-B) No. 2871128 or Japanese Unexamined Patent Application Publication (JP-A) No. 2005-5158.

SUMMARY OF THE INVENTION

In the foregoing connectors, although the contact points of the contacts are each formed circular-arc shaped, there is no particular means for avoiding collision between the tips of the contacts at the time of the fitting and there is also no particular means for guiding the tips of the contacts. Further, when the contacts are arranged at a narrow pitch, the connection between the connectors is unstable due to occurrence of pitch deviation.

It is therefore an exemplary object of this invention to provide a connector that facilitates fitting to a mating connector by guiding the tips of contacts and still has high connection reliability.

Other objects of the present invention will become clear as the description proceeds.

According to an exemplary aspect of the present invention, there is provided a connector adapted for connection to a mating connector, comprising a housing and a contact coupled to the housing, wherein the contact comprises a holding portion held by the housing, a contact receiving portion extending from the holding portion and adapted to contact a portion of the mating connector, a spring portion extending from the contact receiving portion and movable relative to the housing, and a contact portion provided at the spring portion and adapted to contact another portion of the mating connector, wherein the housing comprises an accommodating portion accommodating therein at least a portion of the contact receiving portion and a guide portion adapted to guide the portion of the mating connector toward the accommodating portion.

According to an exemplary aspect of the present invention, there is provided a connecting device comprising a pair of mutually connectable connectors, wherein each of the pair of connectors comprises a housing and a contact coupled to the housing, wherein the contact comprises a holding portion held by the housing, a contact receiving portion extending from the holding portion, a spring portion extending from the contact receiving portion and movable relative to the housing, and a contact portion provided at the spring portion, wherein the contact receiving portion is adapted to contact the contact portion of the contact of the mating connector in the pair of connectors, wherein the contact portion is adapted to contact the contact receiving portion of the contact of the mating connector, wherein the housing comprises an accommodating portion accommodating therein at least a portion of the contact receiving portion and a guide portion adapted to guide the contact portion of the contact of the mating connector toward the accommodating portion.

DESCRIPTION OF THE PREFERRED EMBODIMENT

Figure 1:
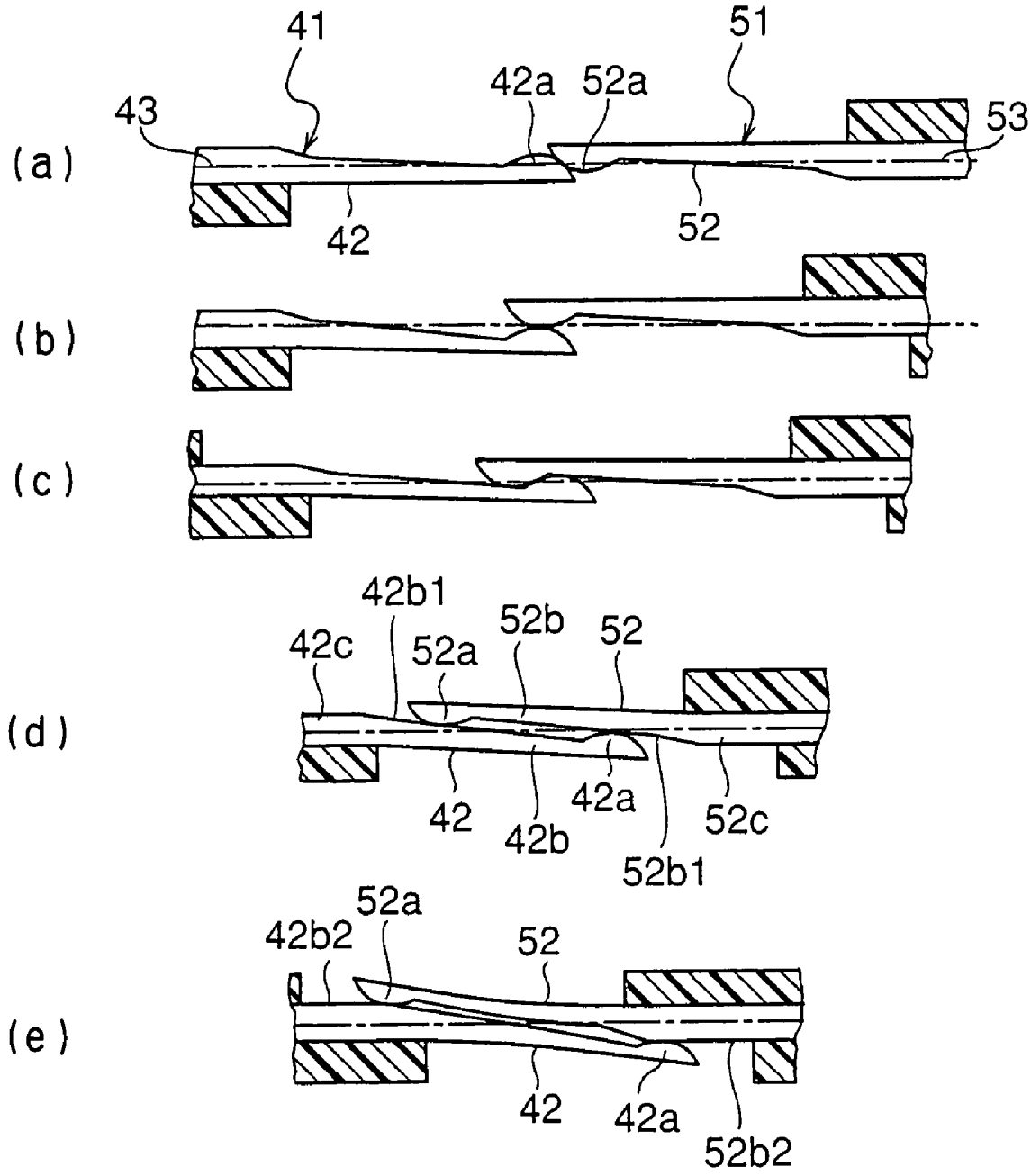
FIG. 1 RELATED ART
FIG. 1 is an exemplary diagram showing the behavior of contacts in a fitting operation, from its beginning to end, between connectors of the related art.

Referring to FIGS. 2A to 5, description will be given of a connecting device according to an exemplary embodiment of this invention. The connecting device is depicted by reference numeral 1 in FIG. 4B and comprises a plug connector 11 and a receptacle connector 21 fitted thereto.

Figure 2A:
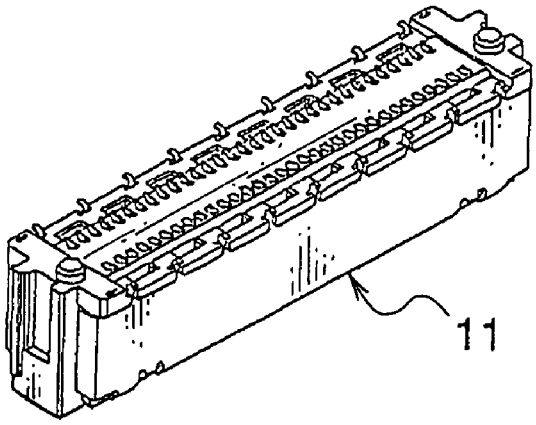
FIG. 2A is a perspective view of a plug connector in a connecting device according to an exemplary embodiment of this invention.
Figure 2B:
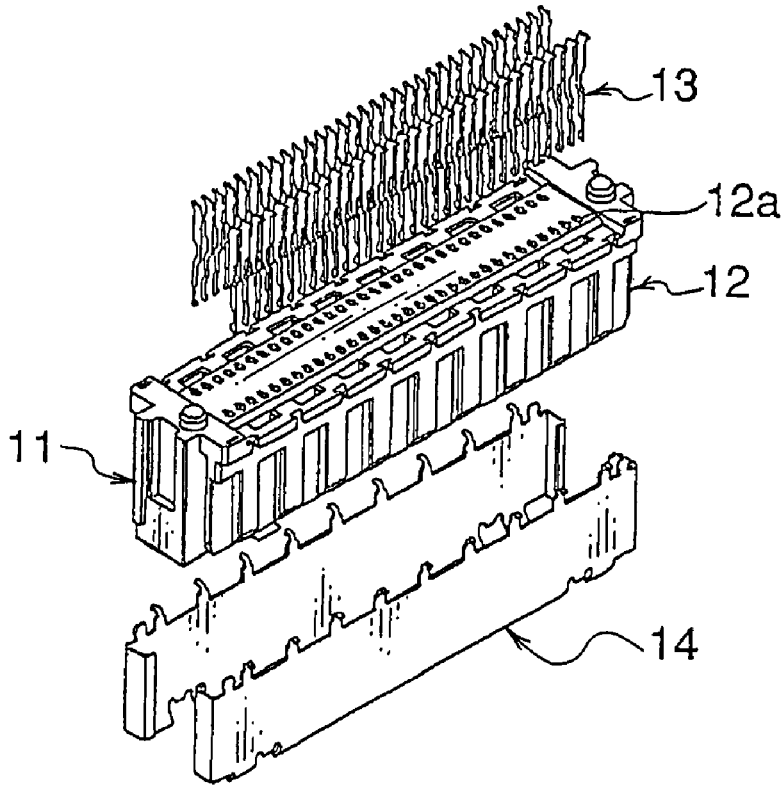
FIG. 2B is an exploded perspective view of the plug connector shown in FIG. 2A.

In FIGS. 2A and 2B, the plug connector 11 includes a plug-side insulator (housing) 12. In the middle of the plug-side insulator 12, a large number of pairs of contact holding holes 12*a* are provided in two rows at a predetermined pitch. A large number of pairs of plug-side contacts 13 are inserted into the large number of pairs of contact holding holes 12*a*, respectively, so as to be held. Four sides of the plug-side insulator 12 are covered with a pair of plug-side shells 14.

Figure 3A:
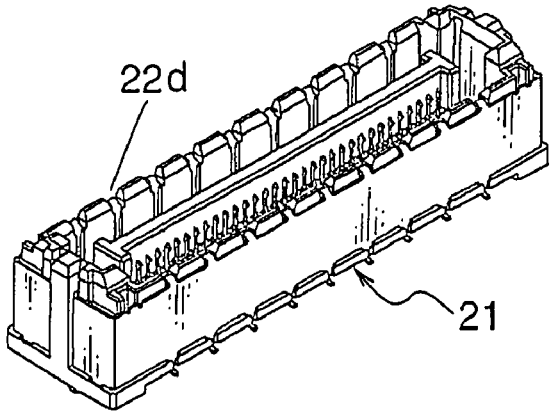
FIG. 3A is a perspective view of a receptacle connector in the connecting device.
Figure 3B:
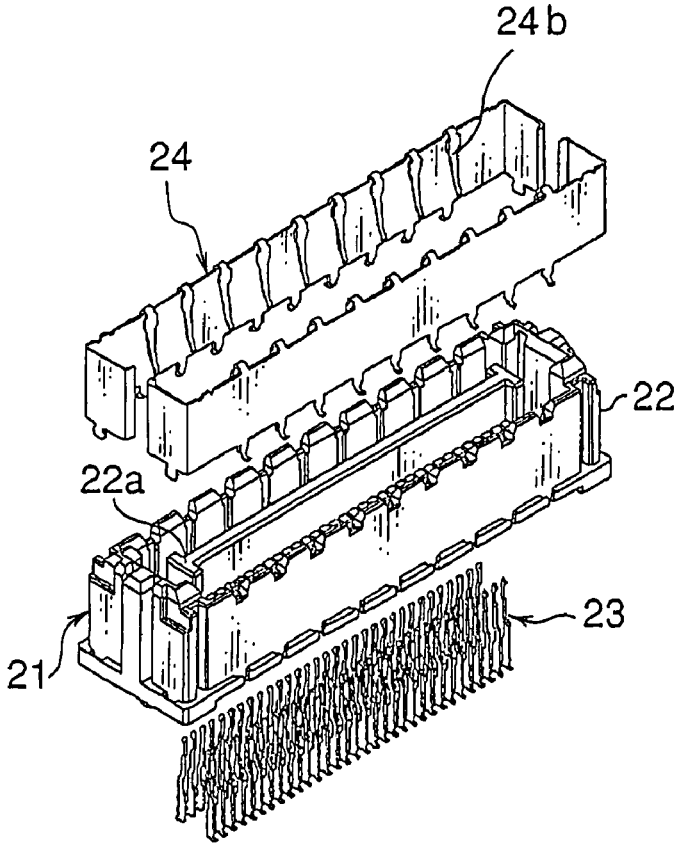
FIG. 3B is an exploded perspective view of the receptacle connector shown in FIG. 3A.

In FIGS. 3A and 3B, the receptacle connector 21 includes a receptacle-side insulator (housing) 22. In the receptacle-side insulator 22, a large number of pairs of contact holding holes 22*b* (see FIG. 4A) are provided in two rows at the predetermined pitch on both sides of a middle partition wall 22*a*. A large number of pairs of receptacle-side contacts 23 are inserted into the large number of pairs of contact holding holes 22*b*, respectively, so as to be held. Four sides of the receptacle-side insulator 22 are covered with a pair of receptacle-side shells 24.

The receptacle-side shells 24 have a plurality of spring contact portions 24*b* adapted to contact the plug-side shells 14. The receptacle-side insulator 22 has a plurality of grooves 22*d* for insertion of the spring contact portions 24*b*.

Figure 4A:
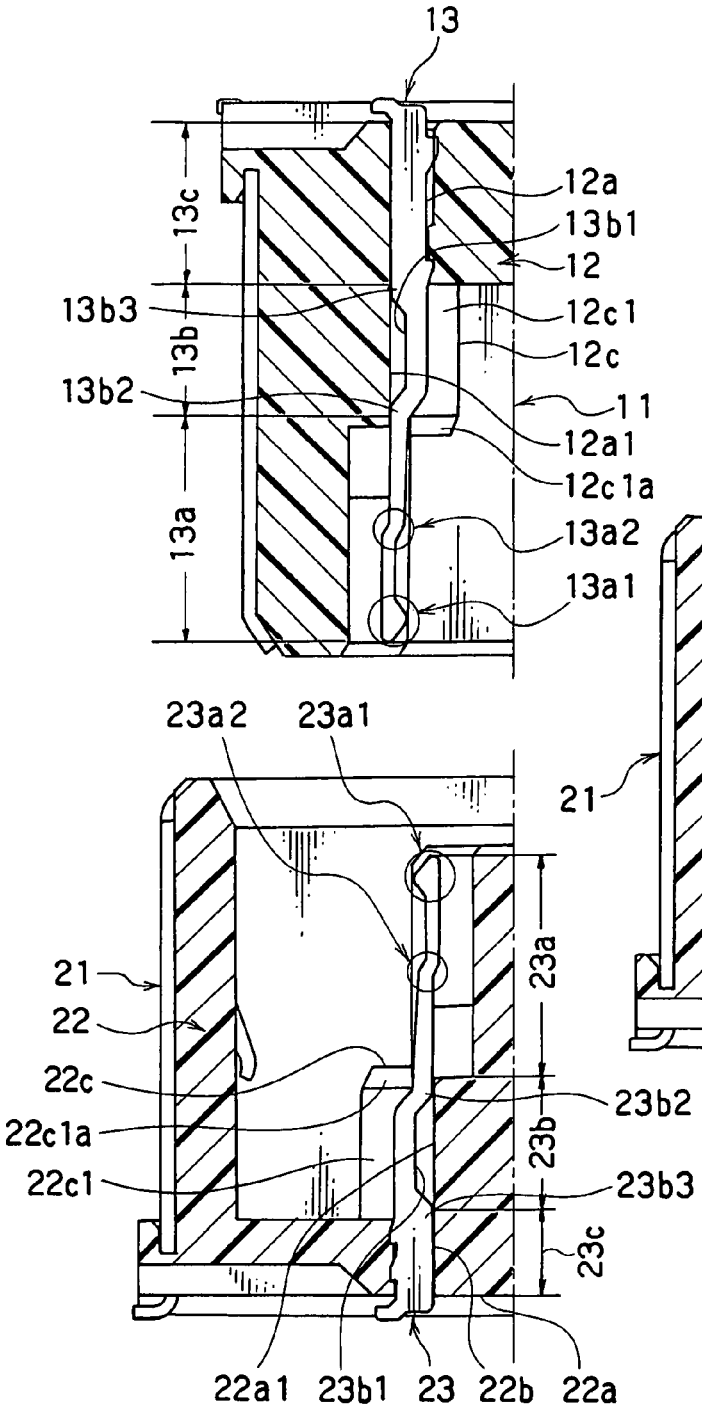
FIG. 4A is an enlarged half sectional view showing a state before the fitting of the plug connector and the receptacle connector of the connecting device.

FIG. 4A shows a state before the fitting of the plug connector 11 and the receptacle connector 21.

The plug-side contacts 13 are each integrally formed by a spring portion 13*a*, a contact receiving portion (intermediate portion) 13*b*, and a holding portion (press-fitting portion) 13*c* held by the plug-side insulator (housing) 12.

The spring portion 13*a* has at its tip a contact portion 13*a*1 adapted for connection to a contact receiving portion 23*b* of the corresponding receptacle-side contact 23, and a crank portion 13*a*2 in the middle thereof.

Except one end adjacent to the spring portion 13*a* and the other end adjacent to the holding portion 13*c*, the contact receiving portion 13*b* is partly omitted on its side opposite to its side adapted for connection to a contact portion 23*a*1 of the corresponding receptacle-side contact 23 so as to have a narrow width about half the width of the holding portion 13*c*. In other words, the contact receiving portion 13*b* has a shallow concave portion 13*b*1 facing a bottom wall 12*a*1 of the contact holding hole 12*a* with a space therebetween, and abutting portions 13*b*2 and 13*b*3 abutting against the bottom wall 12*a*1 on both sides of the concave portion 13*b*1.

Similarly, the receptacle-side contacts 23 are each integrally formed by a spring portion 23*a*, the contact receiving portion (intermediate portion) 23*b*, and a holding portion (press-fitting portion) 23*c* held by the receptacle-side insulator (housing) 22.

The spring portion 23*a* has at its tip the contact portion 23*a*1 adapted for connection to the contact receiving portion 13*b* of the corresponding plug-side contact 13, and a crank portion 23*a*2 in the middle thereof.

Except one end adjacent to the spring portion 23*a* and the other end adjacent to the holding portion 23*c*, the contact receiving portion 23*b* is partly omitted on its side opposite to its side adapted for connection to the contact portion 13*a*1 of the corresponding plug-side contact 13 so as to have a narrow width about half the width of the holding portion 23*c*. In other words, the contact receiving portion 23*b* has a shallow concave portion 23*b*1 facing a bottom wall 22*a*1 of the contact holding hole 22*b* with a space therebetween, and abutting portions 23*b*2 and 23*b*3 abutting against the bottom wall 22*a*1 on both sides of the concave portion 23*b*1.

Figure 4B:
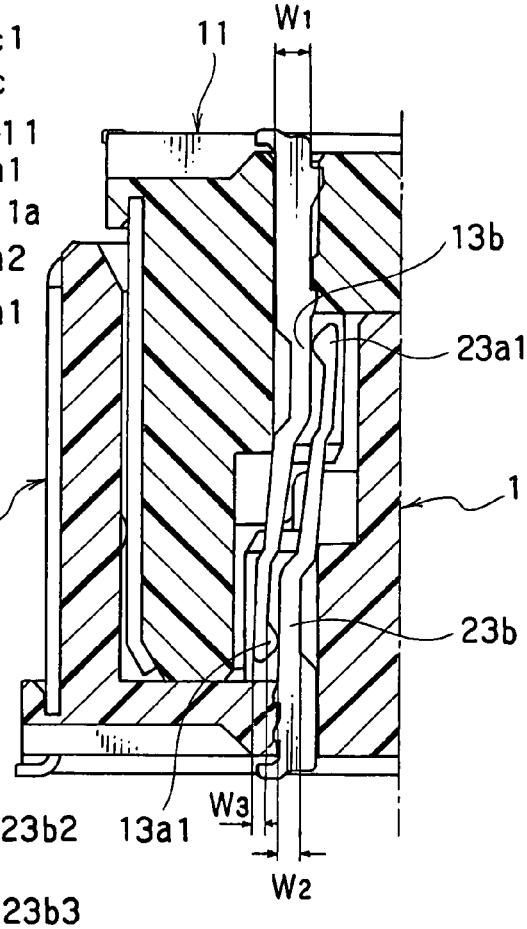
FIG. 4B is an enlarged half sectional view showing a state after the fitting of the plug connector and the receptacle connector of the connecting device.

Further, as shown in FIG. 4B, given that the width of each of the holding portions 13*c* and 23*c* is W1, the width of each of the contact receiving portions 13*b* and 23*b* is W2, and the width of each of the spring portions 13*a* and 23*a* is W3, a design is made to satisfy a relationship of $W2+W3 \leqq W1$. That is, the dimensions of the respective portions are designed so that the sum of the width of the contact receiving portion and the width of the spring portion is no greater than the width of the holding portion. This makes it possible to uniformize or equalize the impedances at the respective portions at the time of the connection between the connectors, thereby achieving excellent impedance matching. Therefore, it is possible to provide the connecting device excellent in high-frequency transmission.

FIG. 4B shows a state after the fitting of the plug connector 11 and the receptacle connector 21. In this state, the contact portions 13*a*1 of the plug-side contacts 13 are connected to the contact receiving portions 23*b* of the receptacle-side contacts 23, respectively, and the contact portions 23*a*1 of the receptacle-side contacts 23 are connected to the contact receiving portions 13*b* of the plug-side contacts 13, respectively.

Figure 5:
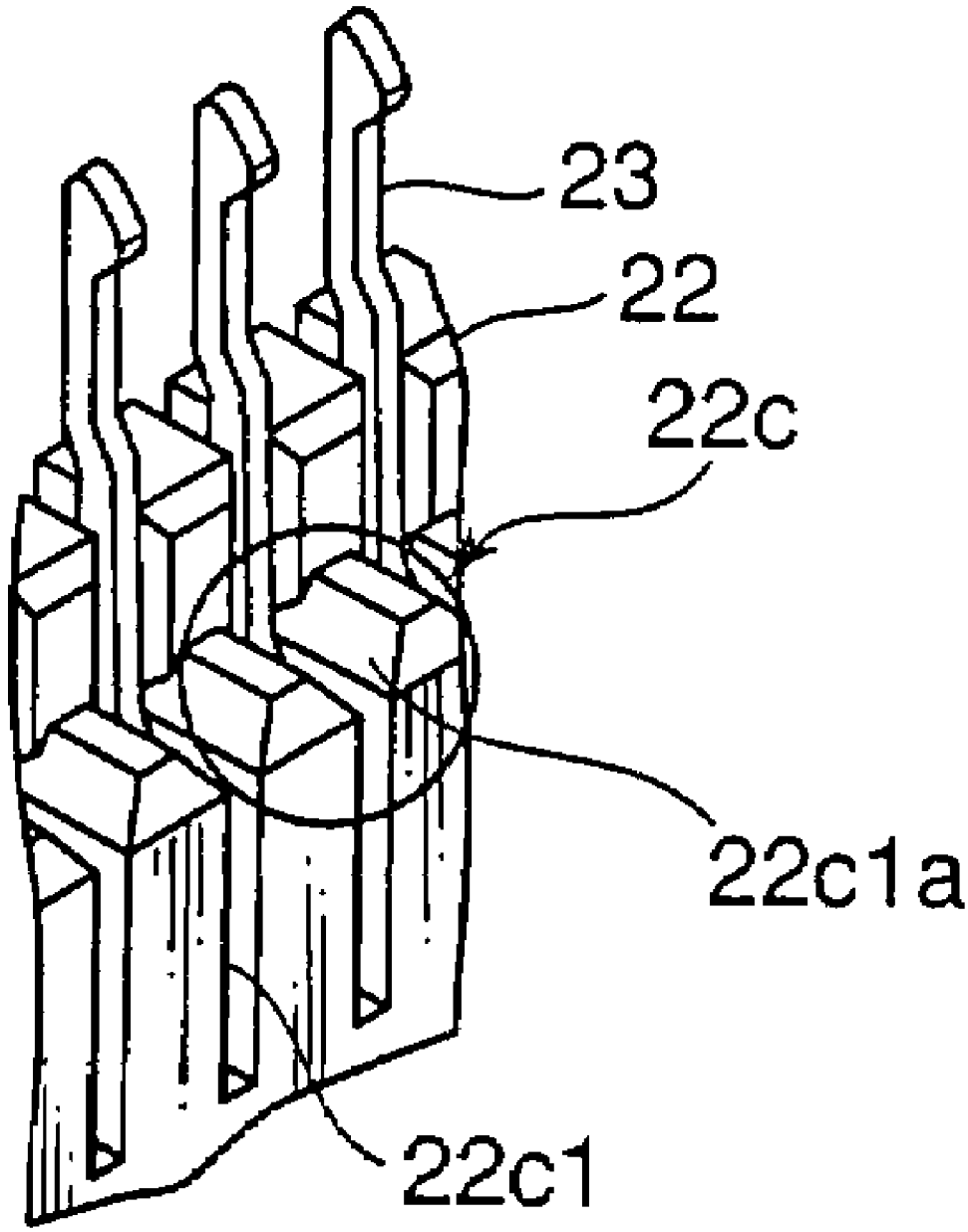
FIG. 5 is a perspective view showing only a main part of the receptacle connector shown in FIG. 3A.

Referring also to FIG. 5 in addition to FIG. 4A, mold walls 22*c* are formed parallel to and on both sides of the middle partition wall 22*a* in the lower part of the receptacle-side insulator 22. The mold walls 22*c* each have the bottom wall 22*a*1 being part of the middle partition wall 22*a*.

Each mold wall 22*c* has a large number of groove-shaped accommodating portions 22*c*1 accommodating therein at least portions of the contact receiving portions 23*b* of the large number of receptacle-side contacts 23, respectively. Each accommodating portion 22*c*1 has at its entrance a tapered guide portion 22*c*1*a* adapted to guide the contact portion 13*a*1 of the corresponding plug-side contact 13 at the time of the fitting.

Mold walls 12*c* of the plug-side insulator 12 have the same structure as that of the mold walls 22*c* of the receptacle-side insulator 22. That is, each mold wall 12*c* also has accommodating portions 12*c*1 corresponding to the accommodating portions 22*c*1, guide portions 12*c*1*a* corresponding to the guide portions 22*c*1*a*, and the bottom wall 12*a*1 corresponding to the bottom wall 22*a*1.

As clear from FIG. 4B, each of the contact receiving portions 13*b* and 23*b* is adapted to contact the contact portion 23*a*1 or 13*a*1 of the mating-side contact on the side opposite to the concave portion 13*b*1 or 23*b*1. Therefore, since the contact receiving portions 13*b* and 23*b* can also be elastically displaced, the reliability of contact is improved.

Further, since each of the contacts 13 and 23 is held by the abutment of both ends of the concave portion 13*b*1 or 23*b*1 of the contact receiving portion 13*b* or 23*b* against the bottom wall 12*a*1 or 22*a*1 of the accommodating portion 12*c*1 or 22*c*1, the position accuracy of the contact receiving portions 13*b* and 23*b* is excellent.

Each plug-side contact 13 is provided with the crank portion 13*a*2 and each receptacle-side contact 23 is provided with the crank portion 23*a*2. Therefore, at the time of the fitting of the plug connector 11 and the receptacle connector 21, collision between the contact portions 13*a*1 and 23*a*1 of the contacts 13 and 23 is avoided and thus the contacts 13 and 23 are prevented from buckling.

In the illustrated example, the holding portions (press-fitting portions) 13*c* and 23*c* of the contacts 13 and 23 have mutually different shapes, but may be configured to have the same shape.

Further, by configuring the insulators (housings) 12 and 22 of the connectors 11 and 21 to have the same shape and also the shells 14 and 24 to have the same shape, the connectors 11 and 21 can be configured to be of the hermaphroditic type.

The foregoing connecting device exhibits the following effects.

1. Since the contact portions of the contacts of the connectors are guided by the guide portions of the mating connectors at the time of the fitting, collision between the tips of the contacts of the connectors is avoided and thus the connectors can be smoothly fitted together.

2. Since the connectors can be configured as hermaphroditic-type connectors, the cost is reduced and, further, handling of the connectors is facilitated.

3. The contact receiving portion of each contact is formed into a generally U-shape and both ends of the generally U-shape abut against the bottom wall of the accommodating portion. Therefore, since each contact receiving portion can also be elastically displaced, the reliability of contact is improved. Further, since each contact is held at the predetermined position of the housing, the position accuracy of each contact receiving portion is excellent.

While the present invention has thus far been described in connection with a few embodiments thereof, it will readily be possible for those skilled in the art to put this invention into practice in various other manners.

What is claimed is:

1. A connector adapted for connection to a mating connector, comprising a housing and a contact coupled to the housing, wherein the contact comprises:

a holding portion held by the housing;

a contact receiving portion extending from the holding portion and adapted to contact a portion of the mating connector;

a spring portion extending from the contact receiving portion and movable relative to the housing; and a contact portion provided at the spring portion and adapted to contact another portion of the mating connector, wherein the housing comprises:

an accommodating portion accommodating therein at least a portion of the contact receiving portion; and a guide portion coupled to the accommodating portion and tapered to guide the portion of the mating connector toward the accommodating portion.

2. The connector according to claim 1, wherein the contact receiving portion is designed to be narrower in width than the holding portion.

3. The connector according to claim 1, wherein the sum of a width of the spring portion and a width of the contact receiving portion is designed to be no greater than a width of the holding portion.

4. The connector according to claim 1, wherein the spring portion has a crank portion at a midway portion between the contact portion and the contact receiving portion.

5. The connector according to claim 1, wherein the accommodating portion has a bottom wall facing the contact receiving portion.

6. The connector according to claim 5, wherein the contact receiving portion comprises:

a concave portion facing the bottom wall with a space therebetween; and abutting portions abutting against the bottom wall on both sides of the concave portion.

7. A connecting device comprising a pair of mutually connectable connectors, wherein each of the pair of connectors comprises a housing and a contact coupled to the housing, wherein the contact comprises:

a holding portion held by the housing;

a contact receiving portion extending from the holding portion;

a spring portion extending from the contact receiving portion and movable relative to the housing; and a contact portion provided at the spring portion, wherein the contact receiving portion is adapted to contact the contact portion of the contact of the mating connector in the pair of connectors, wherein the contact portion is adapted to contact the contact receiving portion of the contact of the mating connector, wherein the housing comprises:

an accommodating portion accommodating therein at least a portion of the contact receiving portion; and a guide portion coupled to the accommodating portion and tapered to guide the contact portion of the contact of the mating connector toward the accommodating portion.

8. The connecting device according to claim 7, wherein the contact receiving portion is designed to be narrower in width than the holding portion.

9. The connecting device according to claim 7, wherein the sum of a width of the spring portion of the contact of one of the pair of connectors and a width of the contact receiving portion of the contact of the other connector is designed to be no greater than a width of the holding portion.

10. The connecting device according to claim 7, wherein the spring portion has a crank portion at a midway portion between the contact portion and the contact receiving portion.

11. The connecting device according to claim 7, wherein the accommodating portion has a bottom wall facing the contact receiving portion.

12. The connecting device according to claim 11, wherein the contact receiving portion comprises:

a concave portion facing the bottom wall with a space therebetween; and abutting portions abutting against the bottom wall on both sides of the concave portion.

* * * * *